US005895339A

United States Patent [19]

Maresh

[11] Patent Number: 5,895,339

[45] Date of Patent: Apr. 20, 1999

[54] ELLIPTICAL EXERCISE METHODS AND APPARATUS

[76] Inventor: Joseph D. Maresh, 19919 White Cloud Cir., West Linn, Oreg. 97068

[21] Appl. No.: 08/953,308

[22] Filed: Oct. 17, 1997

Related U.S. Application Data

[63] Continuation-in-part of application No. 08/497,377, Jun. 30, 1995, Pat. No. 5,707,321.

[51] Int. Cl.[6] ..... A63B 22/00; A63B 22/12

[52] U.S. Cl. ..... 482/51; 482/70

[58] Field of Search ..... 482/51, 52, 53, 482/57, 70, 79, 80

[56] References Cited

U.S. PATENT DOCUMENTS

| | | | |
|---|---|---|---|
| 4,185,622 | 1/1980 | Swenson | 128/25 B |
| 4,786,050 | 11/1988 | Geschwender | 272/73 |
| 5,242,343 | 9/1993 | Miller | 482/57 |
| 5,518,473 | 5/1996 | Miller | 482/57 |
| 5,540,637 | 7/1996 | Rodgers, Jr. | 482/52 |
| 5,562,574 | 10/1996 | Miller | 482/51 |
| 5,577,985 | 11/1996 | Miller | 482/52 |
| 5,593,372 | 1/1997 | Rodgers, Jr. | 482/52 |
| 5,611,758 | 3/1997 | Rodgers, Jr. | 482/57 |
| 5,707,321 | 1/1998 | Maresh | 482/57 |
| 5,769,760 | 6/1998 | Lin et al. | 482/52 |

*Primary Examiner*—Stephen R. Crow

[57] ABSTRACT

An exercise apparatus has a linkage assembly which links rotation of a crank to generally elliptical movement of a foot supporting member. The linkage assembly includes a first link having a first end rotatably connected to a first rocker link, an intermediate portion rotatably connected to the crank, and a second end rotatably connected to a rearward end of the foot supporting member. An opposite, forward end of the foot supporting member is rotatably connected to a second rocker link. An upper distal portion of the second rocker link is sized and configured for grasping by a person standing on the foot supporting member.

20 Claims, 6 Drawing Sheets

ELLIPTICAL EXERCISE METHODS AND APPARATUS

CROSS-REFERENCE TO RELATED APPLICATION

This application is a continuation-in-part of U.S. patent application Ser. No. 08/497,377, filed on Jun. 30, 1995, now U.S. Pat. No. 5,707,321.

FIELD OF THE INVENTION

The present invention relates to exercise methods and apparatus and specifically, to exercise equipment which facilitates exercise through a curved path of motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically links a relatively simple motion, such as circular, to a relatively more complex motion, such as elliptical.

SUMMARY OF THE INVENTION

The present invention may be seen to provide a novel linkage assembly and corresponding exercise apparatus suitable for linking circular motion to relatively more complex, generally elliptical motion. In one embodiment, for example, a crank is rotatably mounted on a frame; an intermediate portion of a first link is rotatably connected to the crank; a first end of the first link is constrained to move in reciprocating fashion relative to the frame; and a second, opposite end of the first link is rotatably connected to a rearward end of a foot supporting member. An opposite, forward end of the foot supporting member is constrained to move in reciprocating fashion relative to the frame. An intermediate portion of the foot supporting member is sized and configured to support a person's foot and is movable in a generally elliptical path relative to the frame.

The present invention may also be seen to provide a novel linkage assembly and corresponding exercise apparatus suitable for linking reciprocal motion to relatively more complex, generally elliptical motion. In a preferred embodiment, for example, a rocker link is rotatably interconnected between the frame and the forward end of the foot supporting member. The upper distal end of the rocker link is sized and configured for grasping by a person standing on the foot supporting member and is movable back and forth in an arc relative to the frame.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
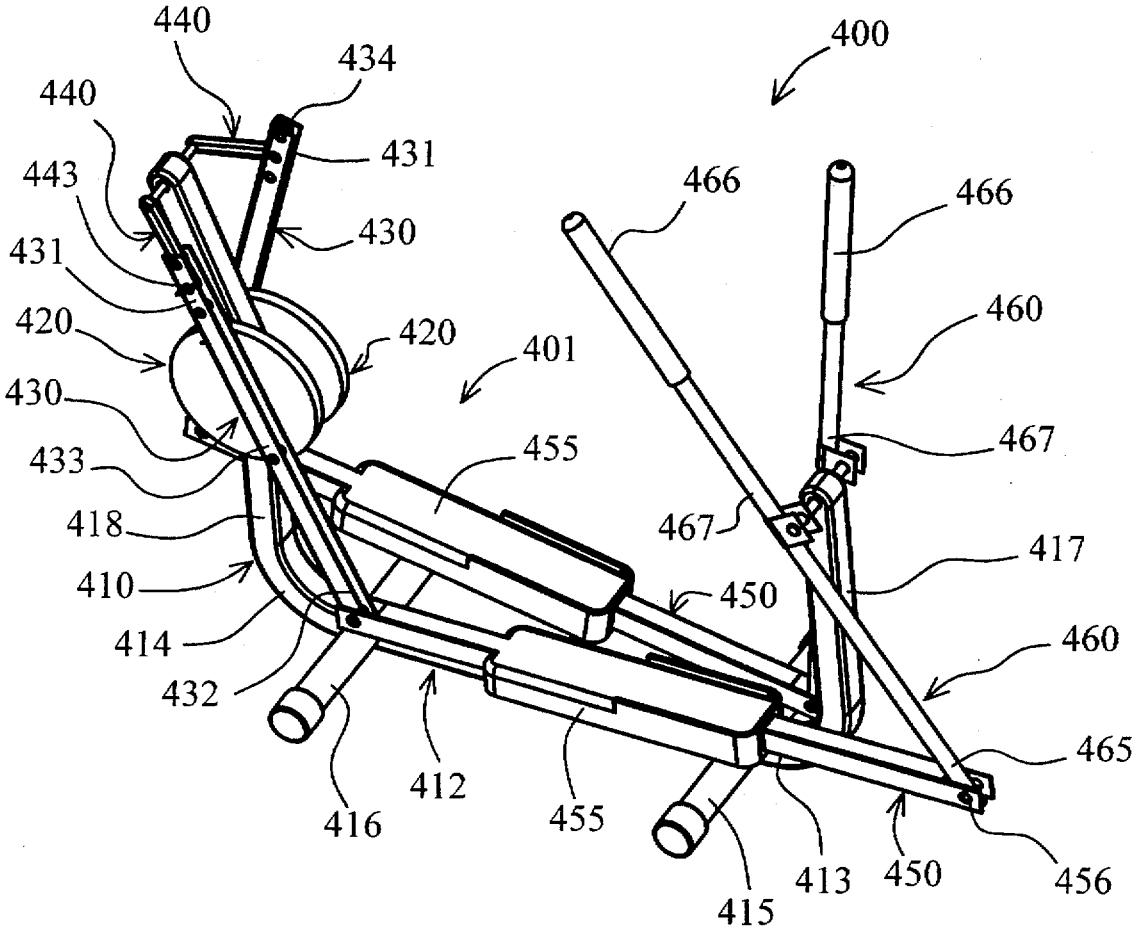
FIG. 1 is a perspective view of a first exercise apparatus constructed according to the principles of the present invention.

A first exercise apparatus constructed according to the principles of the present invention is designated as 400 in FIG. 1. The exercise apparatus 400 generally includes a linkage assembly 401 movably mounted on a frame 410. Generally speaking, the linkage assembly 401 moves relative to the frame 410 in a manner that links rotation of a crank 420 to generally elliptical motion of a force receiving member 455. The term "elliptical motion" is intended in a broad sense to describe a closed path of motion having a relatively longer first axis and a relatively shorter second axis (which is perpendicular to the first axis).

The frame 410 generally includes a base 412 which extends from a forward end 413 to a rearward end 414. A relatively forward transverse support 415 and a relatively rearward transverse support 416 cooperate to stabilize the apparatus 400 relative to a horizontal floor surface. A first stanchion or upright support 417 extends upward from the base 412 proximate its forward end 413. A second stanchion or upright support 418 extends upward from the base 412 proximate its rearward end 414.

The apparatus 400 is generally symmetrical about a vertical plane extending lengthwise through the base 412 (perpendicular to the transverse ends 415 and 416 thereof), the only exception being the relative orientation of certain parts of the linkage assembly 401 on opposite sides of the plane of symmetry. In the embodiment 400, the "right-hand" components are one hundred and eighty degrees out of phase relative to the "left-hand" components. However, like reference numerals are used to designate both the "right-hand" parts and the "left-hand" parts on the apparatus 400, and when reference is made to one or more parts on only one side of the apparatus, it is to be understood that corresponding part(s) are disposed on the opposite side of the apparatus 400. Those skilled in the art will also recognize that the portions of the frame 410 which are intersected by the plane of symmetry exist individually and thus, do not have any "opposite side" counterparts.

The linkage assembly 401 generally includes left and right cranks 420, left and right first links 430, left and right second links or rocker links 440, left and right third links or foot supporting links 450, and left and right fourth links or rocker links 460. On each side of the apparatus 400, a crank 420 is rotatably mounted to the rear stanchion 418 via a common shaft. In the embodiment 400, each crank 420 is a flywheel which is rigidly secured to the crank shaft, so that each crank 420 rotates together with the crank shaft relative to the frame 410. The flywheels 420 add inertia to the linkage assembly 401, and a drag strap or other known device is connected to at least one of the flywheels 420 to provide an element of resistance.

An intermediate portion 433 of each first link 430 is rotatably connected to a respective crank 420. As a result of this arrangement, the first link 430 is rotatable relative to the crank 420 and thereby defines an axis of rotation which, in turn, is rotatable about the crank shaft or crank axis. Each first link 430 has a first distal portion 431 which is rotatably connected to a respective second link 440. Each first link 430 has an opposite, second distal portion 432 which is rotatably connected to a rearward end of a respective third link 450.

Each second link 440 is rotatably interconnected between the stanchion 418 and a respective first link 430 and may be described as a rocker link. As part of an optional adjustment feature, each second link 440 may be secured in any of a plurality of positions along the forked, distal portion 431 of a respective first link 430. In particular, a detent pin 443 is inserted through any of several holes in the first link 430 and an aligned hole in the second link 440. Those skilled in the art will recognize that other known adjusting means, such as a snap button, for example, may be substituted for the detent pin arrangement without departing from the scope of the invention. As a result of the interconnection between the first link 430 and the second link 440, the first link 430 pivots relative to the second link 440 and thereby defines an axis of rotation which, in turn, pivots relative to the stanchion 418. In other words, the upper end of the first link 430 is constrained to move in reciprocating fashion relative to the stanchion 418.

Each third link 450 is rotatably interconnected between a respective first link 430 and a respective fourth link 460. Since the first links 430 are linear in this embodiment 400, the three rotational axes associated therewith lie within a single plane (which extends perpendicular to the drawing sheet of FIG. 1). Each third link 450 has an intermediate portion 455 which is sized and configured to support a person's foot. In this regard, each third link 450 may be described as a force receiving means and/or a foot supporting member. Each third link 450 has an opposite, forward end 456 which is rotatably connected to a lower end 465 of a respective fourth link 460.

An intermediate portion 467 of each fourth link 460 is rotatably connected to the forward stanchion 417. As a result of this arrangement, each third link 450 pivots relative to a respective fourth link 460 and thereby defines an axis of rotation which, in turn, pivots relative to the frame 410. In other words, each fourth link 460 is rotatably interconnected between a respective third link 450 and the frame 410 and may be described as a rocker link and/or as a means for constraining the forward end 456 of the third link 450 to move in reciprocating fashion relative to the frame 410. An opposite, upper end 466 of each fourth link 460 is sized and configured for grasping by a person standing on the foot supports 455. In this regard, each fourth link 460 may be described as a force receiving means and/or a hand supporting member.

To use the apparatus 400, a person stands with a respective foot on each of the foot supports 455 and begins moving his or her feet through striding motions. The linkage assembly 401 constrains the person's feet to move through elliptical paths while the cranks 420 rotate relative to the frame 410. The point of interconnection between the first link 430 and the second link 440 may be moved along the length of the former in order to adjust (primarily) the foot path length. The handles 466 move in reciprocal fashion during rotation of the cranks 420, so that the person may exercise his or her arms simply by grasping a respective handle 466 in each hand. In the alternative, the person may wish to simply balance during leg exercise and/or steady himself or herself relative to a stationary support (not shown) on the frame 410.

Those skilled in the art will recognize that the apparatus 400 is only one of many possible embodiments of the present invention. For example, the rocker links 460 could be replaced by rollers mounted on the forward ends of the foot supporting links 450 and in rolling contact with a ramp or tracks mounted on the frame. Furthermore, the rearward stanchion 418 could angle forward (instead of rearward), so that the axis defined between the rockers 440 and the stanchion 418 would be disposed (above and) forward of the crank axis. Moreover, an upper portion of the rear stanchion could be pivotally mounted to a lower portion thereof and selectively moved relative thereto in order to adjust (primarily) the foot travel inclination.

Figure 2:
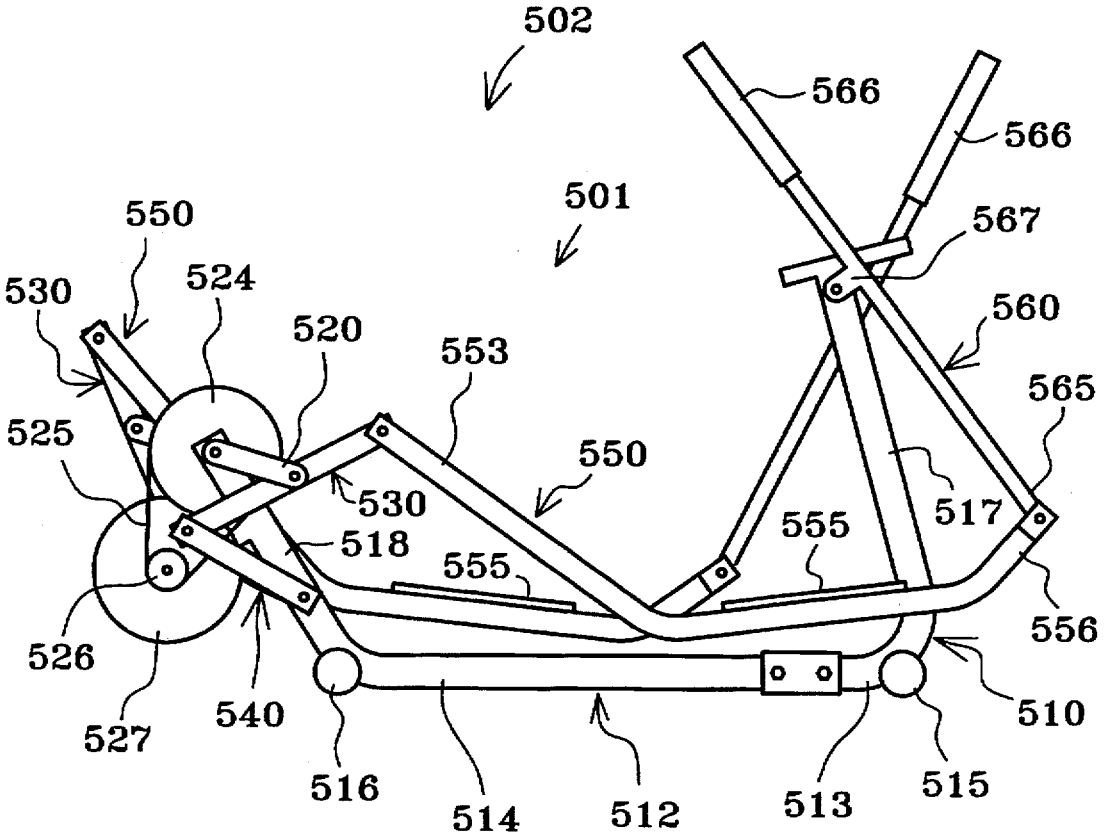
FIG. 2 is a side view of a second exercise apparatus constructed according to the principles of the present invention.
Figure 3:
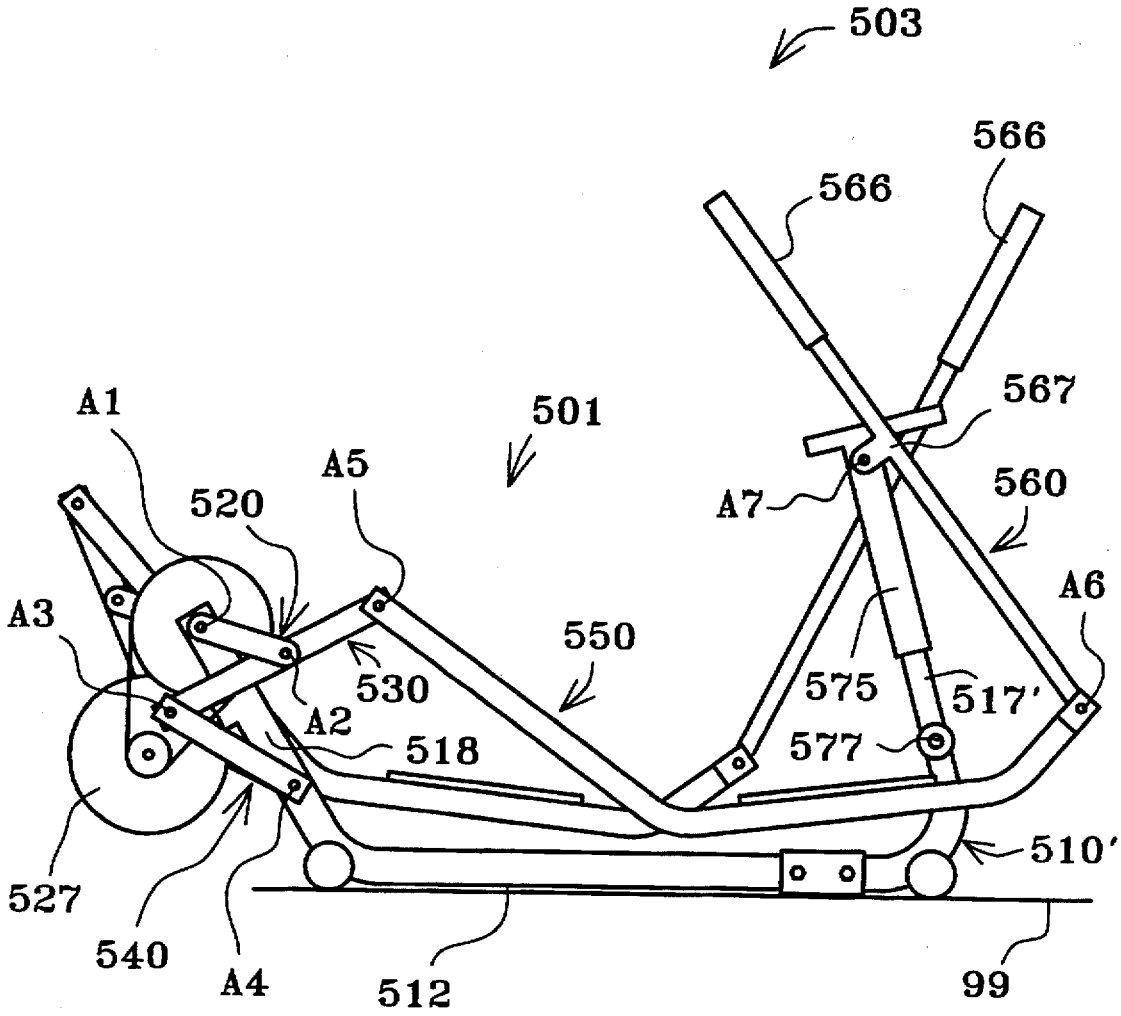
FIG. 3 is a side view of a third exercise apparatus constructed according to the principles of the present invention.
Figure 4:
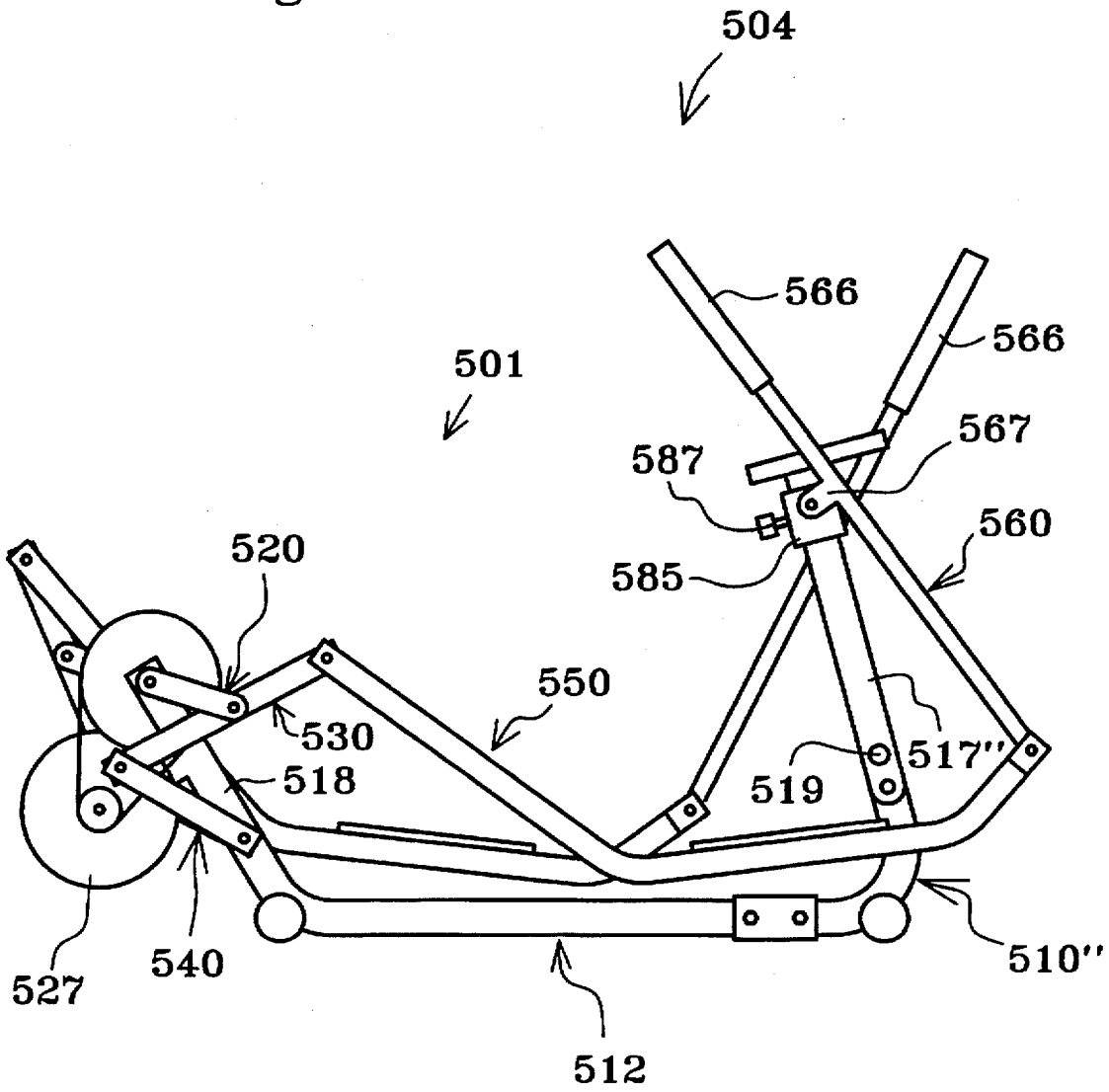
FIG. 4 is a side view of a fourth exercise apparatus constructed according to the principles of the present invention.

Additional variations of the present invention are described with reference to exercise machines 502, 503, and 504, which are shown in FIGS. 2, 3, and 4, respectively. As suggested by the common reference numerals, these three embodiments are identical to one another except for their respective frames 510, 510', and 510".

The frame 510 on the embodiment 502 (shown in FIG. 2) generally includes a base 512 which extends from a forward end 513 to a rearward end 514. A relatively forward transverse support 515 and a relatively rearward transverse support 516 cooperate to stabilize the apparatus 502 relative to a horizontal floor surface 99. A first stanchion or upright support 517 extends upward from the base 512 proximate its forward end 513. A second stanchion or upright support 518 extends upward from the base 512 proximate its rearward end 514.

The frame 510' on the embodiment 503 (shown in FIG. 3) includes the same base 512 and rearward stanchion 518, but has a different forward stanchion 517'. In particular, the stanchion 517' extends upward from the base 512 and supports a sliding member 575. A motor 577 is operable to move the sliding member 575 up and down relative to the stanchion 517'.

The frame 510" on the embodiment 504 (shown in FIG. 4) similarly includes the same base 512 and rearward stanchion 518, but has a different forward stanchion 517". In particular, the stanchion 517" is pivotally mounted to the base 512 and selectively secured in place by a pin 519 extending through aligned holes in the stanchion 517" and the base 512. A sliding member 585 is movably mounted on the stanchion 517" and selectively secured in place by means of a threaded knob 587.

Each of the machines 502–504 is also similar in several respects to the first embodiment 400. However, the configuration and arrangement of parts are somewhat different. Among the similarities, each exercise apparatus 502–504 generally includes a linkage assembly 501 movably mounted on a respective frame. Generally speaking, the linkage assembly 501 moves relative to the frame 510 in a manner that links rotation of a crank 520 to generally elliptical motion of a force receiving member 555. The term "elliptical motion" is intended in a broad sense to describe a closed path of motion having a relatively longer first axis and a relatively shorter second axis (which is perpendicular to the first axis).

The linkage assembly 501 generally includes left and right cranks 520, left and right first links 530, left and right second links or rocker links 540, left and right third links or foot supporting links 550, and left and right fourth links or rocker links 560. On each side of each apparatus 502–504, a crank 520 is rotatably mounted to the rear stanchion 518 via a common shaft. As a result, the cranks 520 rotate about a crank axis A1 (see FIG. 3) relative to the stanchion 518.

An intermediate portion of each first link 530 is rotatably connected to a respective crank 520. As a result of this arrangement, the first link 530 is rotatable relative to the crank 520 and thereby defines an axis of rotation A2 which, in turn, is rotatable about the crank axis A1. Each first link 530 has a first distal portion which is rotatably connected to a respective second link 540. Each first link 530 has an opposite, second distal portion which is rotatably connected to a rearward end 553 of a respective third link 550.

Each second link 540 is rotatably interconnected between the stanchion 518 and a respective first link 530 and may be described as a rocker link. As a result of the interconnection between the first link 530 and the second link 540, the first link 530 pivots relative to the second link 540 and thereby defines an axis of rotation A3 which, in turn, pivots relative to the stanchion 518 and thereby defines an axis of rotation A4. In other words, the distal portion of the first link 530 is constrained to move in reciprocating fashion relative to the stanchion 518.

Each third link 550 is rotatably interconnected between a respective first link 530 and a respective fourth link 560. The third link 550 pivots relative to the first link 530 and thereby defines an axis of rotation A5 which, in turn, pivots about the axis of rotation A2. Since the first link 530 is linear in these embodiments 502–504, the axes A5, A2, and A3 lie within a single plane (which extends perpendicular to the drawing sheet for FIG. 3). Each third link 550 has an opposite, forward end 556 which is rotatably connected to a lower end 565 of a respective fourth link 560. Each third link 550 has an intermediate portion 555 which is sized and configured to support a person's foot. In this regard, each third link 550 may be described as a force receiving means and/or a foot supporting member.

An intermediate portion 567 of each fourth link 560 on the machine 502 is rotatably connected to the forward stanchion 517; and an intermediate portion of each fourth link 560 on the machine 503 is rotatably connected to the sliding member 575; and an intermediate portion of each fourth link 560 on the machine 504 is rotatably connected to the sliding member 585. As a result of each such arrangement, each third link 550 pivots relative to a respective fourth link 560 and thereby defines an axis of rotation A6 which, in turn, pivots relative to a respective frame member about an axis A7. In other words, each fourth link 560 is rotatably interconnected between a respective third link 550 and a respective frame member and may be described as a rocker link and/or as a means for constraining the forward end 556 of the third link 550 to move in reciprocating fashion relative to the frame member.

On the machines 503 and 504, the relative height of the axis A7 may be adjusted, as described above, in order to change the inclination of exercise motion. Those skilled in the art will recognize that a similar adjustment arrangement could be provided on the first embodiment 400, as well. An opposite, upper end 566 of each fourth link 560 is sized and configured for grasping by a person standing on the foot supports 555. In this regard, each fourth link 560 may be described as a force receiving means and/or a hand supporting member.

In terms of other differences between the machine 400 and the machines 502–504, a stepped-up flywheel arrangement is provided on each of the latter. In particular, a relatively large diameter pulley 524 is rigidly mounted to the crank shaft. As a result, the pulley 524 rotates together with the cranks 520 about the axis A1 relative to the stanchion 518. A closed loop or belt 525 connects the large pulley 524 to a relatively small diameter pulley 526 which rotates together with a flywheel 527 and a discrete shaft relative to the stanchion 518. The result is a "stepped-up" flywheel 527 which rotates faster than the crank shaft and the cranks 520. A drag strap (not shown) is disposed about the flywheel 527 in a manner known in the art in order to provide resistance to rotation of the flywheel 527 and the cranks 520. Those skilled in the art will recognize that other known types of devices may be added to or substituted for the flywheel arrangement to provide momentum and/or resistance to exercise movement.

Another distinction involving the embodiments 502–504 is that the rocker axis A4 is disposed beneath and forward of the crank axis A1. On the embodiment 400, on the other hand, the rocker axis is disposed above and rearward of the crank axis. This particular change in axis positions is accompanied by relatively shorter first links 530 and somewhat U-shaped third links 550. Those skilled in the art will recognize that other changes in axis positions may be provided without departing from the scope of the present invention. For example, machines could also be designed with the rocker axis beneath and rearward of the crank axis or with the rocker axis above and forward of the crank axis. In general, the configurations with the relatively high rocker axes (as on the apparatus 400) provide more favorable adjustability of the exercise stroke (i.e. increases in size accompanied by relatively small variations in shape), and the configurations with the relatively low rocker axes (as on the apparatus 502–504) provide more favorable "feeling" in the exercise stroke (i.e. a relatively slower power stroke followed by a relatively quicker return stroke).

Figure 5:
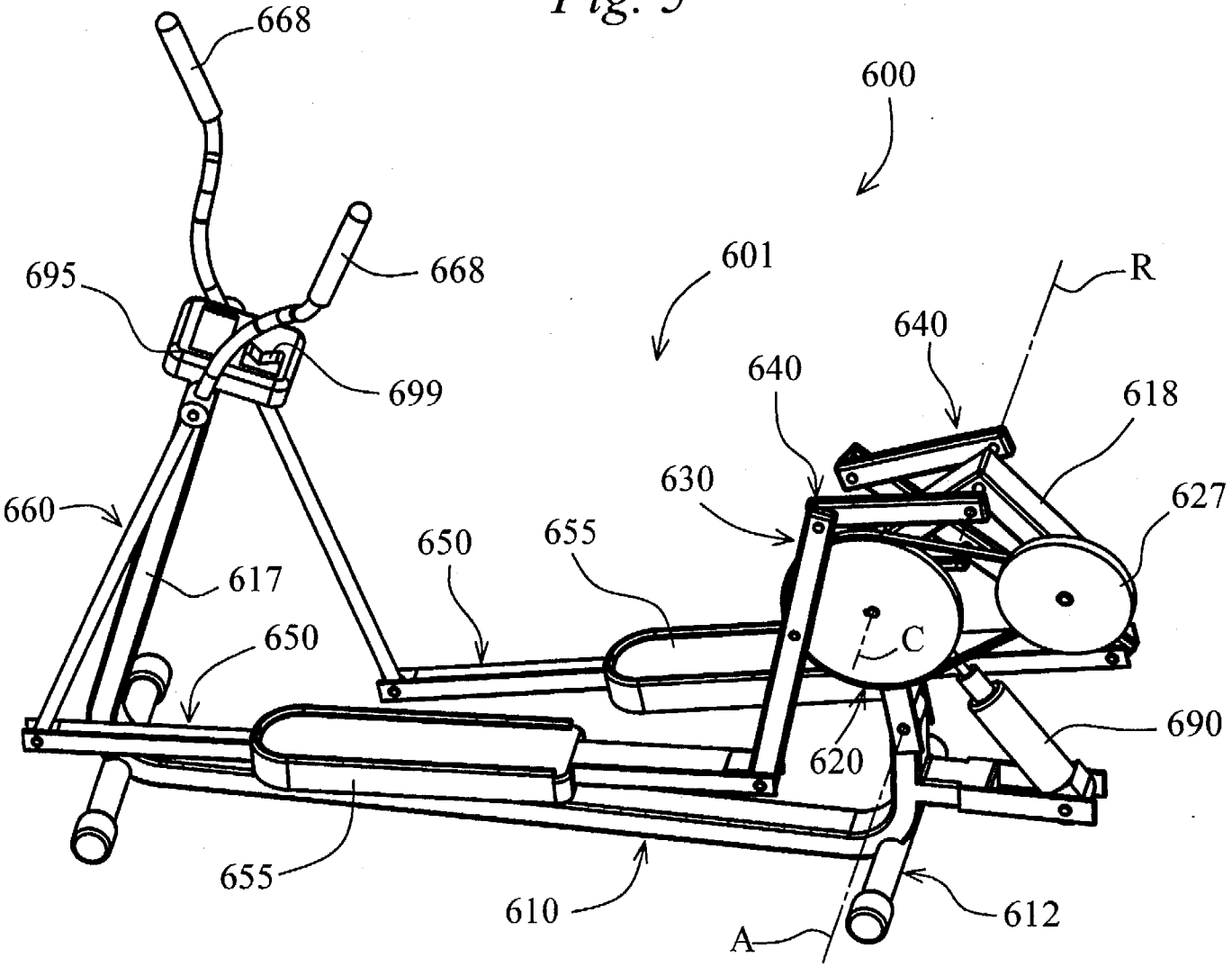
FIG. 5 is a perspective view of yet another exercise apparatus constructed according to the principles of the present invention.

Yet another embodiment of the present invention is designated as 600 in FIG. 5. The exercise apparatus 600 has a linkage assembly 601 which is similar in many respects to the assembly 401 discussed above. Among other things, the rocker axis R is disposed above and behind the crank axis C.

The apparatus 600 has a frame 610 which includes a base 612 designed to rest upon a floor surface. A forward stanchion or support 617 extends upward from the base 612 proximate the front end thereof, and a rearward stanchion or support 618 extends upward from the base 612 proximate the rear end thereof. However, the rearward support 618 is generally U-shaped and is pivotally mounted to the base 612, thereby defining an axis of rotation A.

Left and right cranks 620 (the former in the form of a large diameter pulley, and the latter in the form of a crank arm) are rotatably mounted on the support 618, thereby defining a crank axis C. A flywheel 627 is also rotatably mounted on the support 618 and is connected to the left crank 620 in a manner which provides a stepped-up flywheel arrangement. Resistance to rotation of the flywheel 627 is also provided by means known in the art.

Left and right rigid links 630 have first or upper ends which are constrained to move in reciprocal fashion relative to the support 618. In particular, left and right rocker links 640 are rotatably connected between the support 618 and respective rigid links 630. The rocker links 640 rotate about a rocker axis R relative to the support 618. The rigid links 630 have intermediate portions which are rotatably connected to respective cranks 620, and the rigid links 630 have opposite, lower ends which are rotatably connected to rearward ends of respective horizontal links 650.

The horizontal links 650 have intermediate portions 655 which are sized and configured to support a person's feet, and the horizontal links 650 have forward ends which are rotatably connected to lower ends of respective vertical links 660. The vertical links 660 have intermediate portions which are rotatably mounted on the forward support 617, and the vertical links 660 have upper ends 668 which are sized and configured for grasping by a person standing on the foot supporting portions 655 of the horizontal links 650.

The resulting assembly 601 constrains the foot supporting members 655 to move through generally elliptical paths of motion contemporaneously with rotation of the cranks 620. A linear actuator 690 is rotatably interconnected between the rearward support 618 and a bracket on the base 612 and is operable to pivot the former relative to the latter. Such pivoting causes both the crank axis C and rocker axis R to move relative to the remainder of the linkage assembly 601 and thereby alters the configuration of the paths traveled by the foot supporting members 655. An advantage of this particular adjustment means is that the location of the foot paths remains generally fixed relative to the base 612 throughout the range of adjustment.

The actuator 690 is connected to a user interface device 695 mounted on the forward support 617. The device 695 includes an input device 699 which is linked to the actuator 690 and movable to operate same. In other words, the person may make the exercise strokes longer or shorter (as measured fore to aft) simply by pushing the button or switch 699. Those skilled in the art will recognize that the switch 699 could be replaced by other suitable means, including a knob, for example, which would not only rotate to make adjustments but also, would cooperate with indicia on the device 695 to indicate the current level of adjustment.

Figure 6:
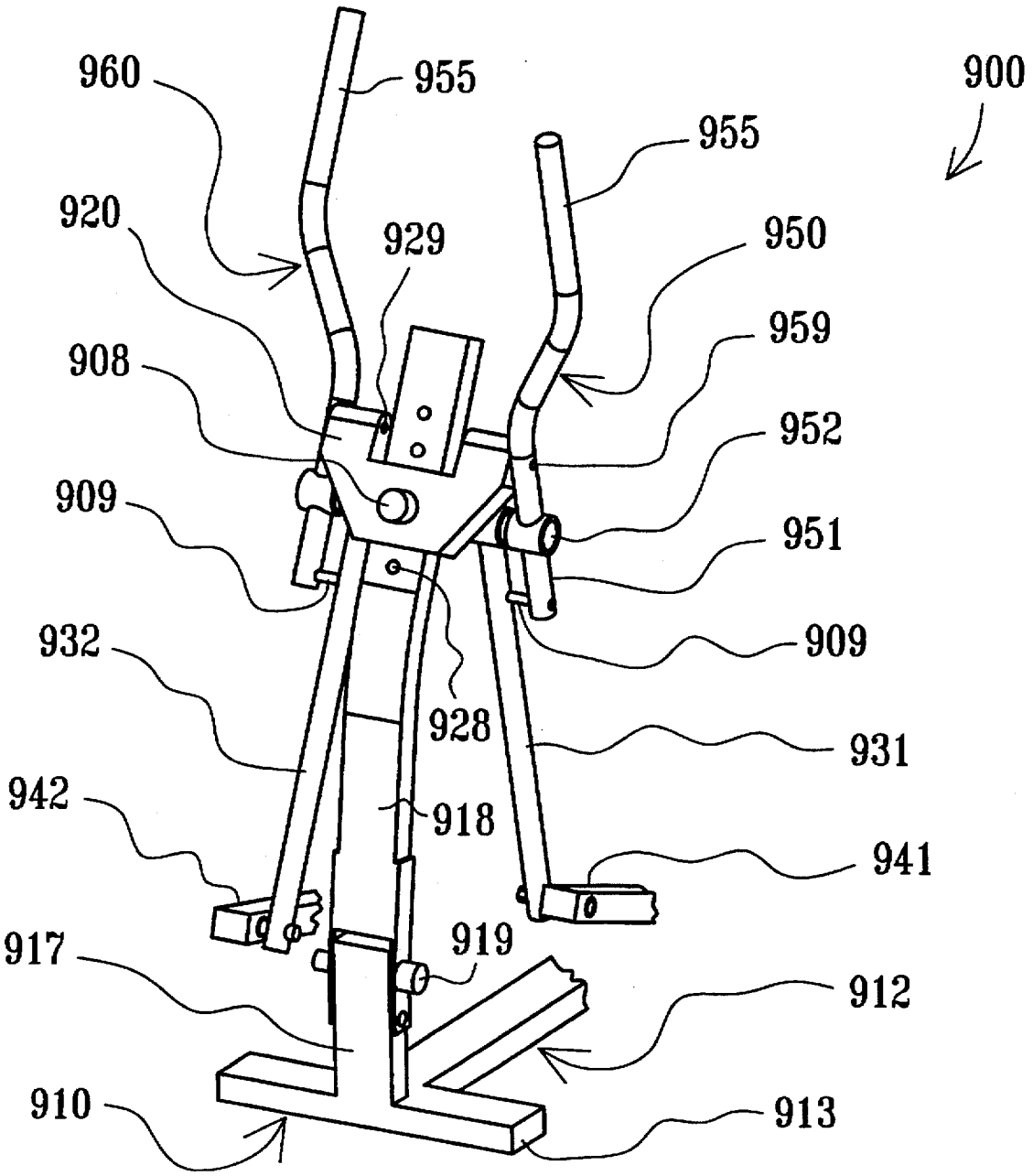
FIG. 6 is a perspective view of a handle assembly suitable for use on any of the exercise apparatus shown in FIGS. 1–5.

Another optional feature of the present invention may be described with reference to a handle assembly 900 shown in FIG. 6. The assembly 900 is shown relative to a frame 910 which includes a base 912 that is supported by transverse supports (one of which is shown as 913). A stanchion or upright 917 extends upward from the base 912 proximate the front end of the frame 910. A post 918 is pivotally mounted on the upright 917 and selectively secured in a generally vertical orientation by means of a ball detent pin 919. The pin 919 may be removed in order to pivot the post 918 to a collapsed or storage position relative to the frame 910.

Another frame member or yoke 920 is slidably mounted on the post 918, between an upper distal end and a pair of outwardly extending shoulders near the lower, pivoting end. A spring-loaded pin 908 (or other suitable fastener) extends through the frame member 920 and into engagement with any of a plurality of holes 928 in the post 918 to selectively lock the frame member 920 at one of a plurality of positions along the post 918 (and above the floor surface supporting the apparatus 900).

Left and right vertical members or rocker links 931 and 932 have upper ends which are rotatably mounted to opposite sides of a shaft 952 on the frame member 920. Opposite, lower ends of the links 931 and 932 are rotatably connected to forward ends of respective foot supporting members 941 and 942. The rearward portions of the foot supporting members 941 and 942, as well as the remainder of the associated linkage assembly components, are not shown to emphasize that the assembly 900 could be provided on any of the foregoing embodiments. In any case, the inclination of the path traveled by the foot supporting members 941 and 942 is a function of the height of the frame member 920 above the floor surface. In other words, the difficulty of exercise can be increased simply by locking the frame member 920 in a relatively higher position on the post 918.

Left and right handle members 950 and 960 are also rotatably connected to opposite ends of the shaft 952 on the frame member 920 and thus, share a common pivot axis with the links 931 and 932. The handle members 950 and 960 include upper, distal portions 955 which are sized and configured for grasping by a person standing on the foot supporting members 941 and 942. A hole is formed through each handle member 950 and 960, proximate its lower end 951 (and beneath the pivot axis), and a corresponding hole is formed through each link 931 and 941 at an equal radial distance away from the pivot axis.

Pins 909 are inserted through the aligned holes to interconnect respective links 931 and 932 and handle members 950 and 960 and thereby constrain each pinned combination to pivot as a unit about the pivot axis. In this particular configuration, the pins 909 may be said to be selectively interconnected between respective handle members 950 and 960 and links 931 and 932, and/or to provide a means for selectively linking respective handle members 950 and 960 and links 931 and 932. Moreover, the pins 909 may be seen to cooperate with the links 931 and 942 to provide a means for selectively linking the handle members 950 and 960 and respective foot supporting members 941 and 942.

Another hole 959 is formed through each of the handle members 950 and 960, above the pivot axis, and corresponding holes 929 are formed in the frame member 920 at an equal distance above the pivot axis. The same pins 909 may alternatively be inserted through the aligned holes 959 and 929 to interconnect the handle members 950 and 960 and the frame member 920 and thereby lock the former in place relative to the latter. In this configuration, the pins 909 may be seen to provide a means for selectively locking the handle members 950 and 960 (but not the links 931 and 932) to the frame 910. In the absence of any such pin connections, the handle members 950 and 960 and the foot supporting members 941 and 942 are free to pivot relative to the frame 910 and one another.

Those skilled in the art will recognize that the present invention may also described in terms of methods (with reference to the foregoing embodiments). For example, the present invention may be seen to provide a method of linking rotation of a crank to generally elliptical movement of a foot supporting member. The method includes the steps of rotatably mounting a crank on a frame; rotatably mounting an intermediate portion of a link on the crank; constraining a first distal portion of the link to move in reciprocating fashion relative to the frame; rotatably connecting an opposite distal portion of the link to a first end of a foot supporting member; and constraining an opposite end of the foot supporting member to move in reciprocating fashion relative to the frame. As used herein, the term "reciprocating" is intended to describe movement in a first direction through a first path followed by movement in a second, opposite direction through a second path which is comparable and/or identical in size and orientation to the first path. The method may further include the step of changing the location of one or more rotational axes, in order to change the path traveled by the foot supporting member.

Those skilled in the art will also recognize additional embodiments and/or applications which differ from those described herein yet nonetheless fall within the scope of the present invention. Among other things, the size, configuration, and/or arrangement of the linkage assembly components may be modified as a matter of design choice, and/or portions thereof may be replaced by mechanical equivalents. For example, the configuration of the link interconnected between the crank, the rear rocker link, and the foot supporting link could be nonlinear or curved, and/or the orientation of the rear rocker link could be opposite to that shown for each arrangement of the rocker axis relative to the crank axis. Recognizing that the foregoing description sets forth only some of the numerous possibilities, the scope of the present invention is to be limited only to the extent of the claims which follow.

What is claimed is:

1. An exercise apparatus, comprising:

a frame designed to rest upon a floor surface;

a left crank and a right crank, wherein each said crank is rotatably mounted on said frame, thereby defining a common first axis;

a left first link and a right first link, wherein each said first link has an intermediate portion, a first distal portion, and a second, opposite distal portion, wherein each said intermediate portion is rotatably connected to a respective crank at a point radially displaced from said first axis, thereby defining a respective second axis, and each said first distal portion is constrained to move in reciprocating fashion relative to said frame;

a left second link and a right second link, wherein each said second link has a rearward portion rotatably connected to said opposite distal portion of a respective first link, an intermediate portion sized and configured to support a person's respective foot, and a forward portion constrained to move in reciprocating fashion relative to said frame; and a resistance device operable to resist rotation of each said crank relative to said frame.

2. The exercise apparatus of claim 1, wherein a separate rocker link is rotatably interconnected between said frame and said first distal portion of each said first link.

3. The exercise apparatus of claim 2, wherein each said rocker link is rotatably connected to said first distal portion of a respective first link at any of several locations along said first link.

4. The exercise apparatus of claim 3, wherein a separate pin inserts through a hole in each said rocker link and any of several holes in a respective first link.

5. The exercise apparatus of claim 2, wherein each said first link rotates about a respective third axis relative to a respective rocker link, and each said rocker link rotates about a common fourth axis relative to said frame, and said fourth axis is disposed beneath and in front of each said first axis.

6. The exercise apparatus of claim 2, wherein each said first link rotates about a respective third axis relative to a respective rocker link, and each said rocker link rotates about a common fourth axis relative to said frame, and said fourth axis is disposed above and behind each said first axis.

7. The exercise apparatus of claim 2, wherein each said first link rotates about a respective third axis relative to a respective rocker link, and each said rocker link rotates about a common fourth axis relative to said frame, and each said second link rotates about a respective fifth axis relative to a respective first link, and said fifth axis, said third axis, and said second axis associated with a respective first link lie in a single plane.

8. The exercise apparatus of claim 2, wherein said frame includes a base and a support movably mounted on said base, and each said first link rotates about a respective third axis relative to a respective rocker link, and each said rocker link rotates about a common fourth axis relative to said support.

9. The exercise apparatus of claim 8, further comprising an actuator interconnected between said support and said base.

10. The exercise apparatus of claim 9, further comprising a controller mounted on said frame and within reach of a person standing on said intermediate portion of each said second link, wherein the controller is connected to said actuator and includes an input device which is operable to move said support relative to said base.

11. The exercise apparatus of claim 8, wherein each said crank is rotatably mounted on said support.

12. The exercise apparatus of claim 11, further comprising an actuator interconnected between said support and said base.

13. The exercise apparatus of claim 12, further comprising a controller mounted on said frame and within reach of a person standing on said intermediate portion of each said second link, wherein the controller is connected to said actuator and includes an input device which is operable to move said support relative to said base.

14. The exercise apparatus of claim 1, wherein said frame includes a base and a support movably mounted on said base, and each said crank is rotatably mounted on said support.

15. The exercise apparatus of claim 14, further comprising an actuator interconnected between said support and said base.

16. The exercise apparatus of claim 15, further comprising a controller mounted on said frame and within reach of a person standing on said intermediate portion each of said second link, wherein the controller is connected to said actuator and includes an input device which is operable to move said support relative to said base.

17. The exercise apparatus of claim 1, wherein a separate rocker link is rotatably interconnected between said frame and said forward portion of each said second link.

18. The exercise apparatus of claim 17, wherein each said rocker link has an upper distal portion which is sized and configured for grasping by a person standing on said intermediate portion of each said second link.

19. The exercise apparatus of claim 17, wherein said frame includes a base and a support movably mounted on said base, and each said rocker link is rotatably connected to said support.

20. The exercise apparatus of claim 1, wherein the resistance device includes a flywheel and drag strap assembly.

* * * * *

UNITED STATES PATENT AND TRADEMARK OFFICE

Certificate

Patent No. 5,895,339 Patented: April 10, 1999

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: Joseph D. Marsh, West Linn, OR and Kenneth W. Stearns, Houston, TX.

Signed and Sealed this Eleventh Day of April, 2000.

RICHARD J. APLEY
Supervisory Patent Examiner,
Art Unit 3764